US005434656A

United States Patent [19]

Nagaoka et al.

[11] Patent Number: 5,434,656

[45] Date of Patent: Jul. 18, 1995

[54] APPARATUS FOR SUPPLYING DEVELOPER AND TONER IN ELECTROPHOTOGRAPHIC IMAGING

[75] Inventors: Shigeki Nagaoka; Toshimasa Okano; Hiroshi Yamada, all of Hyogo, Japan

[73] Assignee: Fujitsu Limited, Kawasaki, Japan

[21] Appl. No.: 347,196

[22] Filed: Nov. 21, 1994

Related U.S. Application Data

[63] Continuation of Ser. No. 89,324, Jul. 12, 1993, abandoned.

[30] Foreign Application Priority Data

Jul. 15, 1992 [JP] Japan ..... 4-187200
Jul. 22, 1992 [JP] Japan ..... 4-195563
Feb. 26, 1993 [JP] Japan ..... 5-037790

[51] Int. Cl.[6] ..... G03G 15/06

[52] U.S. Cl. ..... 355/260; 222/DIG. 1; 355/245

[58] Field of Search ..... 355/260, 245, 215; 222/DIG. 1, 544; 277/12, 80; 156/247; 206/633; 118/653

[56] References Cited

U.S. PATENT DOCUMENTS 4,065,335 12/1977 Pollack ..... 156/69
4,799,608 1/1989 Oka ..... 222/DIG. 1
4,961,450 10/1990 Furuta ..... 222/DIG. 1
5,018,560 5/1991 Tsukamoto ..... 355/260 X
5,030,998 7/1991 Shibata et al. ..... 355/260
5,080,745 1/1992 Paull ..... 156/247
5,126,799 6/1992 Matsuura et al. ..... 355/298
5,142,335 8/1992 Sakata et al. ..... 355/260
5,206,619 4/1993 Kita ..... 355/260
5,207,353 5/1993 Corby et al. ..... 355/260 X
5,260,749 11/1993 Yahata ..... 355/260
5,282,003 1/1994 Michlin ..... 355/260

FOREIGN PATENT DOCUMENTS 59-10967 1/1984 Japan .
64-7084 1/1989 Japan .

*Primary Examiner*—A. T. Grimley
*Assistant Examiner*—T. A. Dang
*Attorney, Agent, or Firm*—Staas & Halsey

[57] ABSTRACT

The object is to carry out developer feeding and toner supplement in a short time without scattering dust particles around, in view of the effectual use of natural resources and space saving. A developer cartridge is removably mounted on a developing unit body and also functions as a lid for closing a developer supply opening after developer has been released into the developing unit body. A toner cartridge includes a lid which can be inserted into and taken out of a toner cartridge body; a sealing member for sealing the toner release opening of the toner cartridge body, the leading edge of which is fixedly attached to the end of the lid on a side from which the lid is inserted; and a tab sheet one end of which is fixed to the middle position of the sealing member and the other end of which is temporarily affixed to the lid. When the sealing member is stripped off, the tab sheet is pulled after the lid has been pulled out as far as a specified position, whereby the sealing member can be folded in two with the toner sticking face inward.

11 Claims, 13 Drawing Sheets

APPARATUS FOR SUPPLYING DEVELOPER AND TONER IN ELECTROPHOTOGRAPHIC IMAGING

This application is a continuation of application Ser. No. 08/089,324, filed Jul. 12, 1993, now abandoned.

TECHNICAL FIELD

The present invention relates to a developing unit for use with an electrophotographic image forming apparatus or similar apparatus and a toner cartridge for supplying toner to the developing unit.

BACKGROUND ART

A known electrophotographic image forming apparatus is arranged such that the surface of a photoreceptor is uniformly charged by means of a front charger while the photoreceptor being rotated; light such as laser beams is projected onto the surface of the photoreceptor from an optical system to form an electrostatic latent image; toner is adhered to the electrostatic latent image in a developing section to form a toner image on the surface of the photoreceptor; the toner image is transferred onto a paper sheet in a transferring section; and the toner image thus transferred is then fixed to the paper sheet in a fixing section.

Most of recent developing units for use with an electrophotographic image forming apparatus having the above-described arrangement are provided with a plurality of stirring paddles and magnet rollers in the main body thereof. In such a developing unit, developer consisting of a mixture of toner and carrier is stored in the main body of the developing unit. The developer is stirred with the stirring paddles so as to be charged by friction and adhered onto the surface of a magnet roller in the form of a magnetic brush, whereby the developer is transferred to the side of the photoreceptor. In this stage, toner is supplemented from a toner hopper to the main body of the developing unit in accordance with the consumption of toner. Although carrier is repeatedly usable, it should be replaced occasionally since carrier tends to loose its charging ability and to be ground into minute particles because of abrasion after long use.

For the replacement of developer, the underside of the main body of the developing unit is provided with a discharge opening with a lid, and the upper side of the main body is provided, at one end thereof, with a small-diameter supply opening with a cap (or plug). The replacement is practically carried out with the following procedure: the lid of the discharge opening is first opened, and with a recovery container being interconnected to the main body of the developing unit through a duct, the stirring paddles are rotated, so that used developer is forced out from the main body into the recovery container. After the discharge opening has been closed with the lid, the supply opening is opened in order that fresh developer is dropped from the developer container into the main body with the help of a funnel or duct.

For supplementing toner to the main body of the developing unit, the following procedure is taken: With a toner cartridge being mounted on the upper side of a toner hopper, a sealing member adhered to cover the opening of the toner cartridge is stripped off, thereby allowing toner to fall into the toner hopper through the opening. In this case, the length of the sealing member is twice the length of the opening of the toner cartridge or more, and the sealing member is folded such that the portion which is not adhered to the opening turns back outwardly and overlaps along the lengthwise direction of the opening. In order to strip the sealing member off, the end of the portion of the sealing member, which is adhered to the outer side of the toner cartridge, is pulled by the user so that the portion adhered to the opening can be stripped off.

The toner cartridge arranged in such a configuration, however, has the problem that while the sealing member is being stripped off, the face of the sealing member facing to the inside of the toner cartridge is directed downwards and toner sticking to the face of the sealing member comes off and flies in all directions with the result that the surroundings of the apparatus is contaminated.

An attempt to overcome the foregoing problem is disclosed in Japanese Patent Publication Laid-Open No. 3-102371 (1991), wherein there is provided a covering member through which the outwardly folded portion of the sealing member is movably inserted and which covers the adhesive part of the sealing member having extended over the opening, when the sealing member is stripped off.

The above prior developing unit still has the various disadvantages such as described below in the replacement of developer.

Concretely, since the prior developing unit is designed such that the bore of the supply opening provided in the main body of the developing unit is not large and moreover the supply opening is disposed at one end of the main body, it does not have a good operating performance for filling the main body with fresh developer and therefore a pretty long time is required for filling. Another problem is that in order to avoid such a situation that the developer supplied is unevenly accumulated in the main body of the developing unit, it is necessary to carry out the filling operation with the stirring paddles being rotated. This is a disadvantage in energy saving.

A further problem Is that minute dust particles such as toner are likely to scatter around during the filling of fresh developer so that the surroundings of the apparatus and user's hands become dirty.

Further, containers for fresh developer are discarded after the filling operation, and this could be disadvantageous in terms of increasing the efficiency of utilizing natural resources. In this respect, it is possible to re-use a container which have been used for fresh developer for storing used developer, however, a space becomes necessary for setting such an empty container aside until used developer is recovered. This gives rise to another problem of space saving.

The prior art disclosed in the above publication also has a problem in the supplement of the toner. Specifically, a great tension force is necessary for pulling the sealing member, since the sealing member and the cover member are so composed that they are moved respective to each other when the sealing member is pulled and fractional resistance is applied to the cover member.

SUMMARY OF THE INVENTION

It is therefore the object of the present invention to overcome the foregoing drawbacks. More specifically, a first object of the present invention is to provide a developing unit capable of being filled with fresh developer in a short time without scattering dust particles around and capable of contributing to the effectual use of natural resources and space saving. A second object of the invention is to provide a toner cartridge capable of efficiently carrying out the toner supplement operation without scattering dust particles around.

With the above objects in view, a developing unit according to the invention comprises:

a developing unit body having a developer supply opening for supplying developer; and a developer cartridge removably mounted on the developing unit body so as to cover and tightly seal the developer supply opening, which has a developer release opening interconnected with the developer supply opening and has the function of a lid for closing the developer supply opening after developer has been released into the developing unit body through the developer release opening.

According to the above-described developing unit, the developer cartridge containing fresh developer is mounted on the developing unit body and the developer release opening is opened, whereby the fresh developer can be released from the developer cartridge into the developing unit body through the developer release opening and the developer supply opening.

After the developer has been released into the developing unit body, the developer supply opening is continuously closed by means of the developer cartridge. This allows the emptied developer cartridge to be effectively used, increasing the efficiency of utilizing natural resources and eliminates the need for a special storing space for the empty developer cartridge since the dead space above the developing unit body can be utilized for storing it.

Further, the developer supply opening of the developing unit body is closed by the developer cartridge all the time, except for a short period during which a developer cartridge containing used developer is removed and a new developer cartridge is mounted for replacement. This reduces the likelihood that dust particles created from developer in the developing unit body as well as developer being released into the developing unit fly in all the directions.

Both sides of the developer supply opening may be provided with presser rails for pressing both side edges of the developer cartridge mounted on the developing unit body. The provision of the presser rains brings the flange of the developer release opening of the developer cartridge mounted on the developing unit body into slidable and tight contact with the periphery of the developer supply opening, so that developer released from the developer cartridge into the developing unit body is prevented from scattering outwardly.

The developer supply opening is substantially equal to the developing unit body in width and the developer supply opening has substantially the same size as the developer release opening of the developer cartridge. This enables the release of developer to be done in an instant without rotating stirring paddles.

Further, the developer release opening is opened by removing the sealing member for sealing the developer release opening in an openable manner after the developer cartridge has been mounted on the developing unit body, which prevents dust particles from escaping from the developer cartridge to scatter around.

In this case, the developer cartridge may be provided with a scraper means for scraping developer adhered to the surface of the sealing member when the sealing member is removed. This allows developer adhered to the sealing member to be scraped, dropping in the developing unit body, and therefore it can be ensured that dust particles are prevented from scattering.

When used developer within the developing unit body is recovered, the empty developer cartridge is taken out and this cartridge is used for recovery of the used developer. Meanwhile, the opening is covered with a new developer cartridge having a sealing member at its opening, and the cap of the empty developer cartridge is removed so that the opening for recovery of developer can be interconnected to the discharge opening formed in the developing unit body.

The developer cartridge may be provided with a property display means for indicating charging properties owned by the developer at the time of manufacturing. The properties indicated by the property display means are read out by means of a reading means disposed in the developing unit body and information on the properties is transferred to a control circuit such as, for example, a toner density control unit or bias voltage control unit, thereby maintaining uniform printing density In accordance with the charging properties of the developer.

According to the invention, there is provided a toner cartridge removably mounted on a toner hopper of a developing unit, comprising:

(a) a toner cartridge body for storing toner therein, provided with a toner release opening that is interconnected with a toner supply opening of the toner hopper;

(b) a lid that can be inserted into and taken out of the toner cartridge body;

(c) a sealing member for sealing the toner release opening of the toner cartridge body, the leading edge of which is fixed to an end of the lid on the side from which the lid is inserted; and (d) a tab sheet a first end of which is secured to the middle position of the sealing member and a second end of which is loosely temporarily affixed to the lid such that it can be freely stripped off, wherein the sealing member can be folded in two in such a manner that the face having toner sticking thereto is directed inwardly, by pulling the tab sheet after the lid has been pulled out as far as a specified position.

According to the above-described toner cartridge, the toner cartridge is set on the toner hopper of the developing unit and the lid is pulled out, whereby the sealing member fixedly attached to the lid is gradually stripped off so that the toner release opening is opened and toner in the toner cartridge can fall into the toner hopper from the toner release opening through the toner supply opening formed under the toner release opening. At the moment that the lid has been pulled out substantially to the end, in other words, the sealing member has been stripped off substantially to the center, the pulling-out of the lid is stopped. Thereafter, the edge of the temporarily affixed end of the tab sheet is stripped off and pulled in the same direction as the pulling-out direction of the lid, thereby pulling out the middle part of the sealing member fixed to the other end edge of the tab sheet. With this, the remaining portion of the sealing member which still seals the toner release opening can be stripped off so that toner falls down while the sealing member is folded in two with the face having toner sticking thereto being directed inwardly and unfolded. Consequentially, toner is prevented from escaping and scattering around the toner hopper.

The lid may be provided with a flat, cylindrical sheet at the face facing to the toner release opening in the inserting/pulling-out direction thereof and the end of the tab sheet is made to pass through the cylindrical sheet and temporarily affixed to the lid. This allows the sealing member to be accommodated in the cylindrical sheet while being folded in two, so that the scattering of toner can be more positively prevented.

In this case, the cylindrical sheet preferably has a length with which the twice-folded toner sticking face of the sealing member can be accommodated in the cylindrical sheet.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and accompanying drawings which are given by way of illustration only, and thus are not limitations of the present invention, and wherein:

FIG. 1 is a perspective view illustrating the external shape of a developing unit according to an embodiment of the invention;

FIG. 2 is a longitudinal section of the developing unit according to the embodiment of the invention;

FIG. 3 is a plan view of the developing unit according to the embodiment of the invention;

FIG. 4 is an exploded perspective view of a developer cartridge according to an embodiment of the invention;

FIGS. 5(*a*), 5(*b*) are perspective views each illustrating the back of the developer cartridge according to the embodiment of the invention, FIG. 5(*a*) showing the developer cartridge from which a sealing member is being stripped off while FIG. 5(*b*) shows the developer cartridge after stripping off the sealing member;

FIG. 6 is a circuit block diagram off the developing unit according to the embodiment of the invention;

FIG. 7 illustrates a procedure for taking out the developer cartridge according to the embodiment of the invention;

FIG. 8 illustrates a procedure for recovering developer according to the embodiment of the invention;

FIG. 9 is an exploded perspective view of a toner cartridge according to an embodiment of the invention;

FIGS. 10(*a*) to 10(*c*) each illustrate a procedure for supplementing toner by use of the toner cartridge according to the embodiment of the invention;

FIG. 11 is an exploded perspective view showing a toner cartridge according to a modification of the embodiment of the invention;

FIG. 12 illustrates a procedure for supplementing toner by the use of the toner cartridge according to the modification;

FIG. 13 is a sectional view of a developer cartridge according to a modification of the embodiment of the invention;

FIG. 14 is a sectional view of a developer cartridge according to another modification of the embodiment of the invention;

FIG. 15(*a*) showing a condition where the developer cartridge is not covered with the lid while FIG. 5(*b*) shows a condition where the developer cartridge is covered with the lid.

DESCRIPTION OF THE PREFERRED EMBODIMENTS

Figure 1:
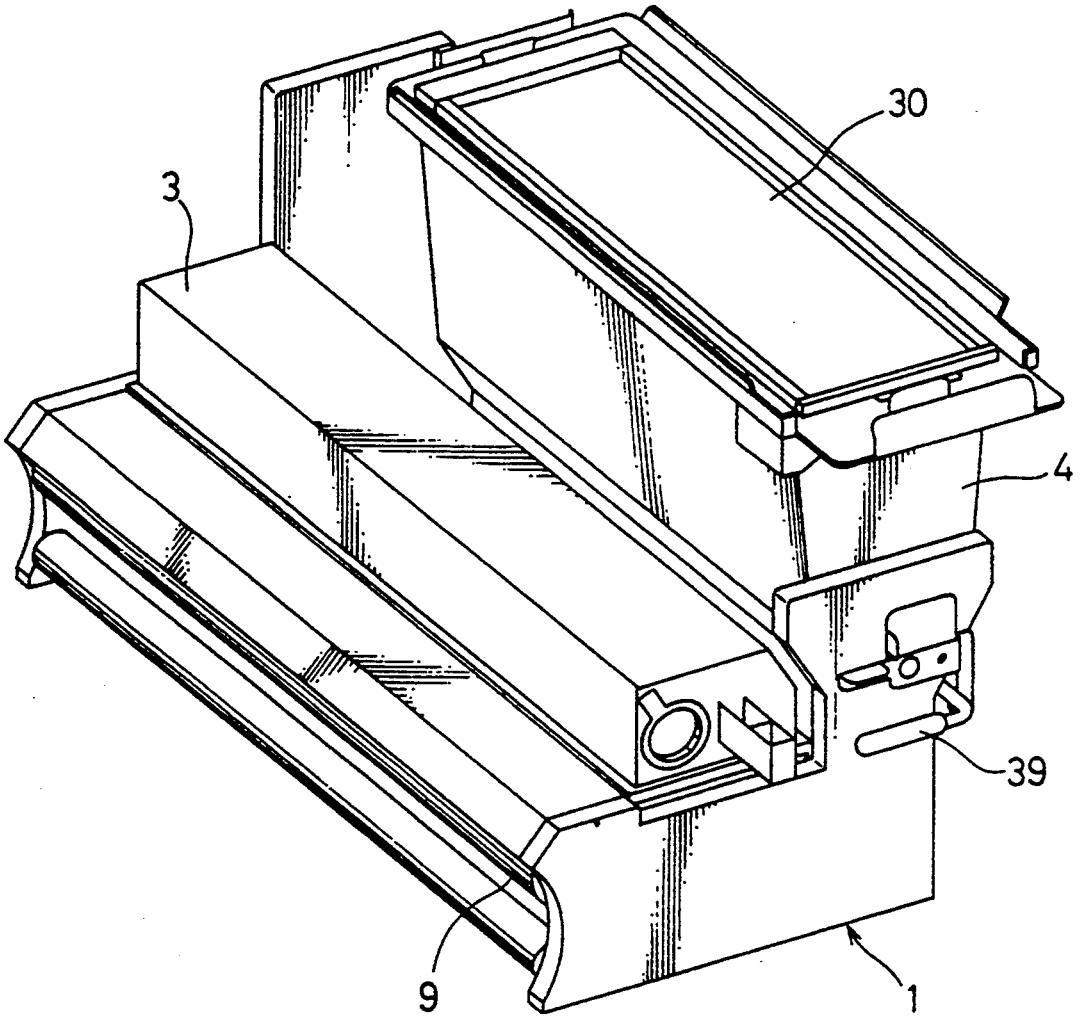
FIGS. 1 to 14 are for explaining preferred embodiments of a developing unit and toner cartridge according to the invention.

Referring now to the drawings, preferred embodiments of a developing unit and toner cartridge according to the invention will be explained hereinafter.

Figure 2:
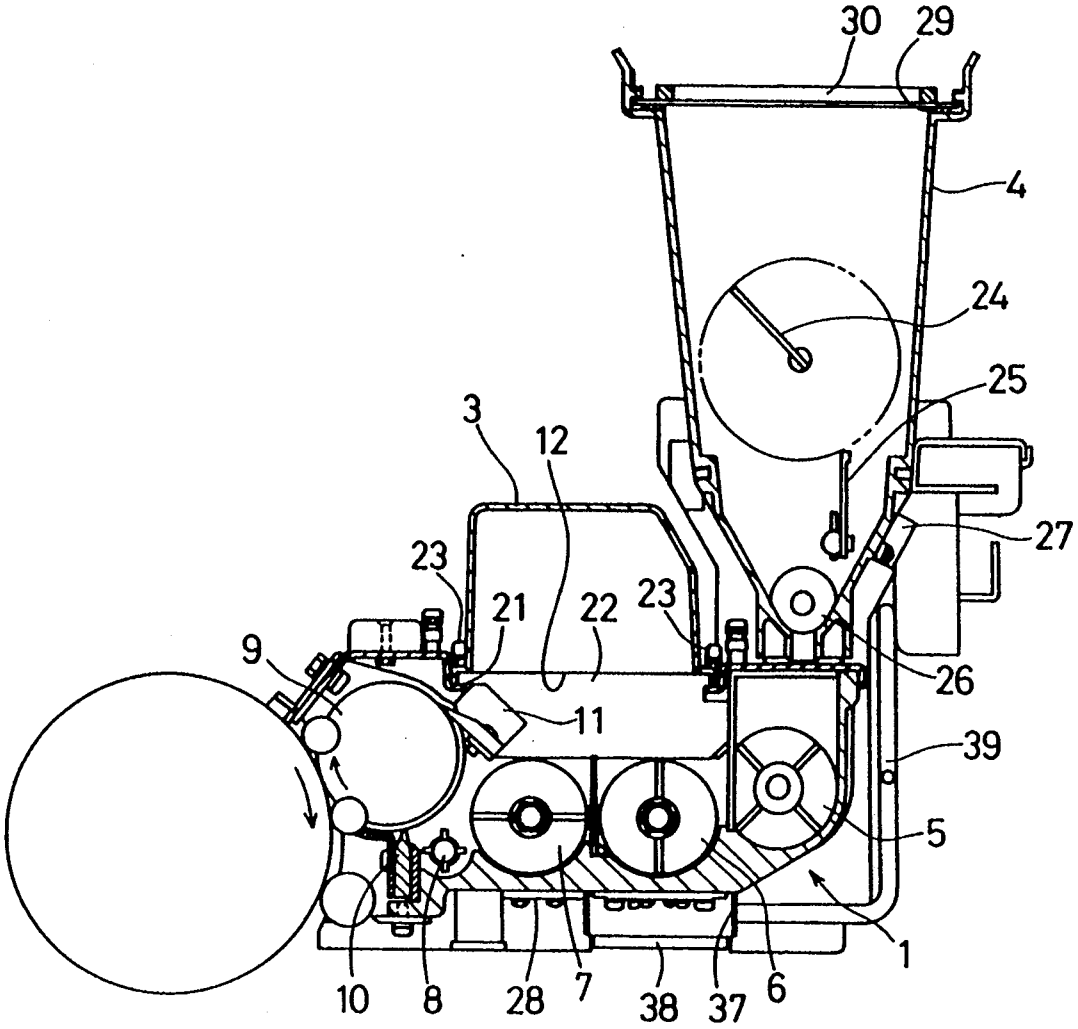
Figure 3:
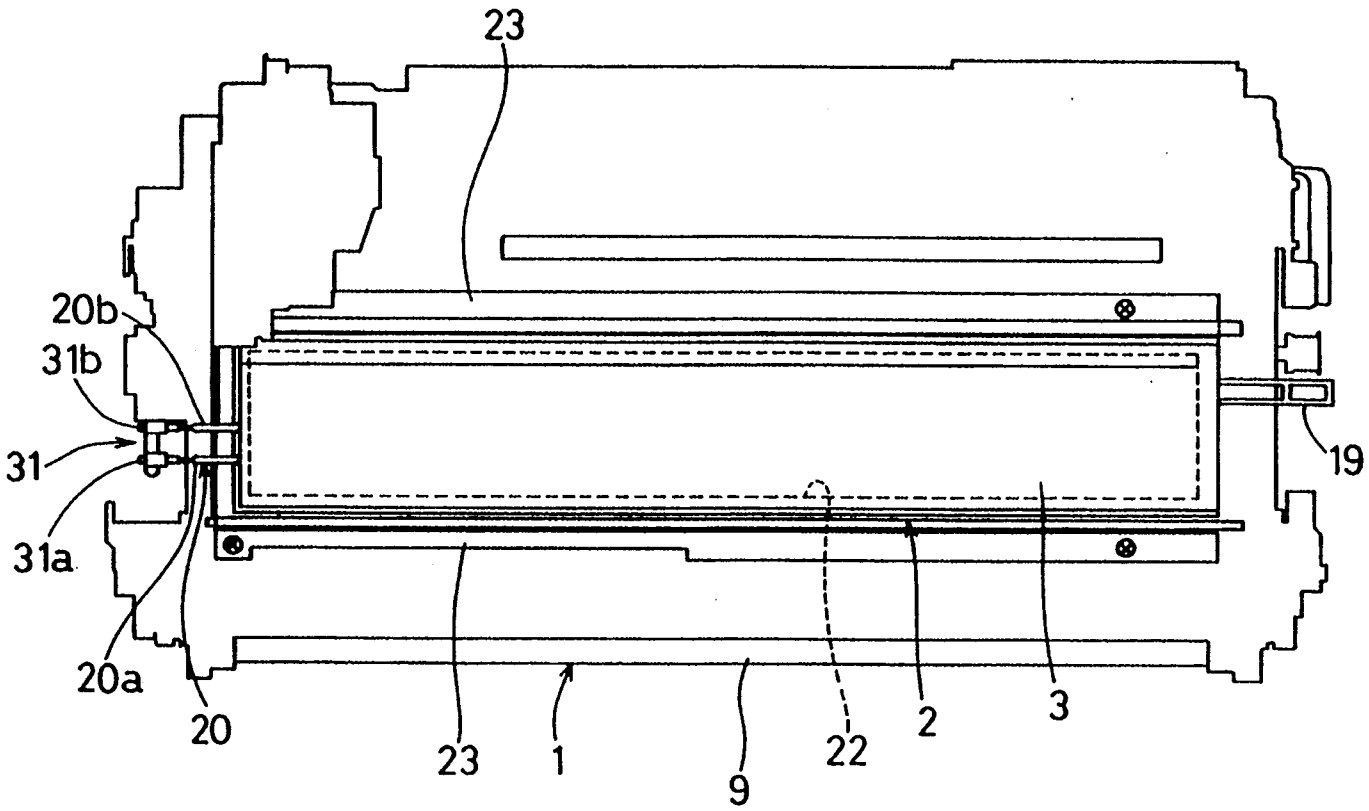

As shown in FIGS. 1 to 3, a developing unit according to one embodiment of the invention comprises a developing unit body 1, a cartridge body 3 of a developer cartridge 2 mounted on the center of the upper face of the developing unit body 1 and a toner hopper 4 removably mounted on the end (right end in FIG. 2) of the upper face of the developing unit body 1.

Disposed within the developing unit body 1 are four stirring paddles 5, 6, 7, 8 which are arranged in parallel alignment in this order from the position beneath the toner hopper 4 and a magnet roller 9 which is positioned adjacently to the stirring paddle 8 and partially projects to the left from the developing unit 1 in FIG. 2. Developer within the developing unit body 1 is charged while being stirred by the stirring paddles 5 to 8 and attracted to the surface of the magnet roller 9 so as to form a magnetic brush thereon.

Within the developing unit body 1, there is also disposed a blade 10 that is downwardly spaced a specified distance apart from the magnet roller 9. The blade 10 scrapes part of the developer sticking to the surface of the magnet roller 9 being rotated, thereby restricting the height of the developer within a certain level, the developer being attracted and deposited in a brush-like form on the surface of the magnet roller 9.

The developing unit body 1 is provided with a flow-regulating board 11 diagonally disposed above the magnet roller 9. The flow-regulating board 11 scrapes developer off the magnet roller 9, this developer having been brought back into the developing unit body 1, as being adhered to the surface of the magnet roller 9. The flow-regulating board 11 allows the developer thus scraped to flow obliquely in the direction toward the axis of the stirring paddle 7 so as to fall onto the stirring paddle 7.

Figure 4:
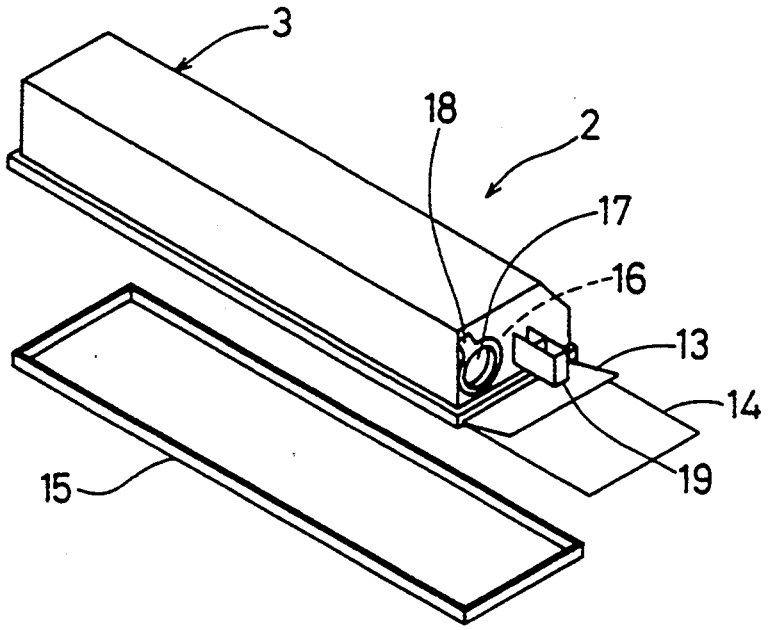
Figure 5A:
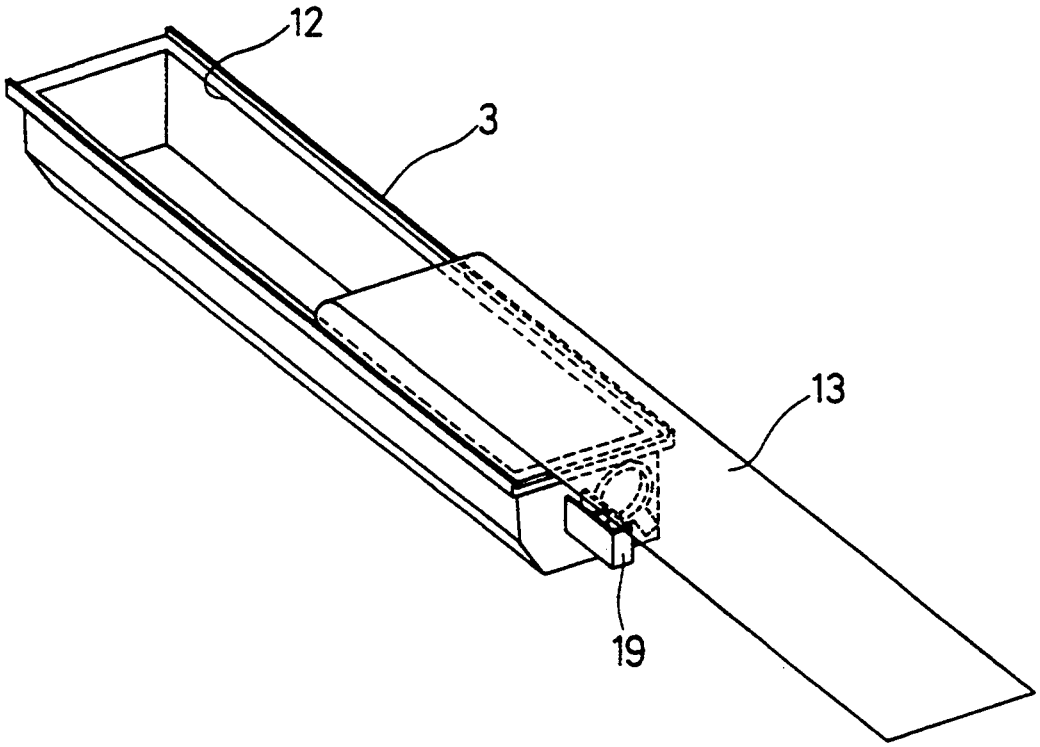
Figure 5B:
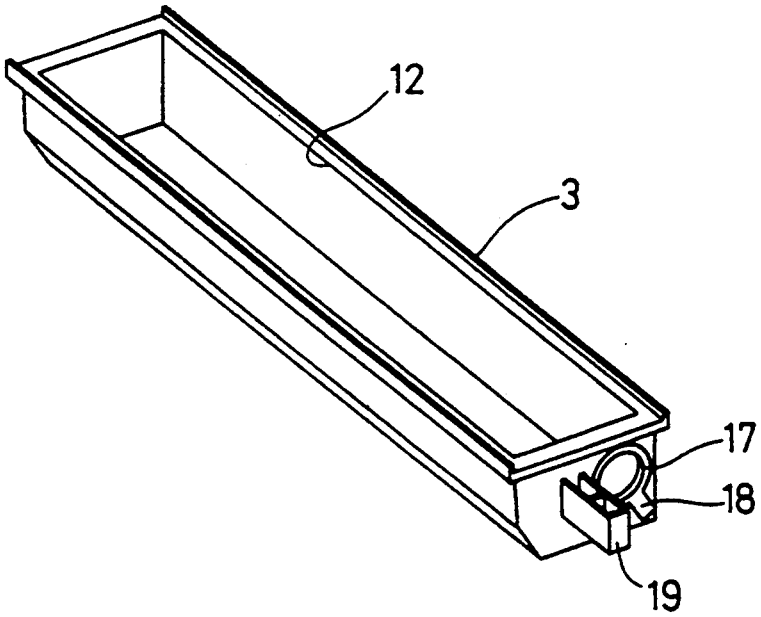

The developer cartridge 2 comprises, as shown in FIGS. 4 and 5, the cartridge body 3 the underside of which can be entirely opened defining a developer release opening 12; a seal 13 made of a synthetic resin film for sealing the developer release opening 12 defined in the cartridge body 3 in such a manner that the opening 12 can be opened; a cardboard sheet 14 which can be so inserted in the cartridge body 3 as to cover the seal 13 and pulled out therefrom; and a lid 15 that is put on the cardboard sheet 14 in order to cover the developer release opening 12. The seal 13 is composed of an adhesive part adhered to the cartridge body 3 in order to cover the developer release opening 12 and a non-adhesive part folded outwardly and disposed on the adhesive part in an overlapping manner. The length of the seal 13 is a little more than twice the length of the cartridge body 3. The developer release opening 12 is sealed with the seal 13 and after the cardboard sheet 14 has been put under the seal 13, the lid 15 is fitted therein.

The cartridge body 3 includes a developer recovery opening 16 defined at one end face thereof and a cap 17 for closing the developer recovery opening 16. The cap 17 is taken from the developer recovery opening 16, a specified amount of fresh developer is then fed to the cartridge body 3 through the developer recovery opening 16, and the cap 17 is put on. In order to avoid missing of the cap 17, the cap 17 is connected to the cartridge body 3 with the help of a strip 18.

One end face of the cartridge body 3 is provided with a tab 19 projecting beside the cap 17. The tab 19 is pushed or pulled when the cartridge body 3 is mounted on the developing unit body i or removed therefrom. As shown in FIG. 3, the other end face of the cartridge body 3 is provided with a property display means 20 for indicating the properties of developer stored in the cartridge body 3. The property display means 20 projects outwardly from the cartridge body 3 and is comprised of probes 20*a*, 20*b* formed of two projections each tip portion of which can be cut away or snapped off. The tip portions of these probes 20*a*, 20*b* may be left without cutting, or either of them may be cut, or the tip portions of both probes 20*a*, 20*b* may be cut, thereby indicating the 3 stages of the properties.

As shown in FIG. 2, the upper face of the developing unit body 1 is provided with a recess 21 from one end of which the lower part of the cartridge body 3 of the developer cartridge 2 can be inserted in the recess 21 or pulled out therefrom in a longitudinal direction. When the cartridge body 3 is inserted in the recess 21, the lower face of the cartridge body 3 is sealed by the seal 13 but the lid 15 and the cardboard sheet 14 arc removed therefrom. By holding the end of the seal 13 and pulling it through the recess 21 in order to strip the seal 13 off as shown In FIG. 5(*a*), the developer release opening 12 can be opened as shown in FIG. 5(*b*). FIGS. 5(*a*) and 5(*b*) each show the developer cartridge 2 that is turned upside down.

The recess 21 is provided with a developer supply opening 22 which opens a little wider than the developer release opening 12. By removing the seal 13, new developer discharged from the developer release opening 12 can be released at an instance into the developing unit body 1 through the developer supply opening 22.

Presser rails 23 are disposed on both sides of the recess 21. The presser rails 23 press both side edges of the cartridge body 3 which has been inserted in the recess 21, whereby the flange of the developer release opening 12 of the cartridge body 3 is brought into slidable, tight contact with the periphery of the developer supply opening 22. This prevents developer released from the cartridge body 3 to the developing unit body 1 from scattering outwardly.

After developer has been released into the developing unit body 1, the cartridge body 3 is continuously retained at the same position. With this arrangement, the developer supply opening 22 of the developing unit body 1 is closed so that minute particles of toner etc. are prevented from scattering around from the developer supply opening 22 and the dead space over the developing unit body 1 can be effectively utilized by storing the empty cartridge body 3 until developer becomes degraded and the empty cartridge body 3 is used for recovering the degraded developer therein as described later.

Disposed in the toner hopper 4 are a rotary vane 24 for preventing the occurrence of a toner bridge, a fixed vane 25 formed under the rotary vane 24 and a sponge roller 26 formed under the fixed vane 25, for closing the opening defined at the lower end of the toner hopper 4. The lower side wall of the toner hopper 4 is provided with an empty sensor 27 for detecting that the amount of toner within the toner hopper 4 is below a certain level. When it is detected by the empty sensor 27 that the amount of toner within the toner hopper 4 is below the specified value, a toner empty warning light on an operation panel (not shown) for example, is lit or flickers, thereby giving a warning to the user.

Toner drops into the toner hopper 4 from a toner cartridge 41 (to be described later) mounted on the upper face of the toner hopper 4. The density of toner within the developing unit body 1 is detected by a density sensor 28 provided at the bottom of the developing unit body 1. When toner density detected by the density sensor 28 is a specified lower limit or less, the sponge roller 26 rotates, thereby supplying toner from the toner hopper 4 to the developing unit body 1. When the density of toner within the developing unit body 1 is retrieved by the toner supply and becomes a specified upper limit or more, the rotation of the sponge roller 26 is suspended thereby stopping the toner supply.

The toner hopper 4 is formed separately from the developing unit body 1 and removably incorporated in the developing unit body 1. This arrangement is particularly useful in such cases as, for example, multi-colour printing where a plurality of developing units are required to be disposed adjacently to one another in a vertical direction, since it is possible that the toner hopper 4 is separated from the developing unit body 1 and instead of the toner hopper 4, a feeder including a feeding screw and a sponge roller is secured onto the developing unit body 1 and toner can be fed from the hopper disposed on a side of the developing unit body 1 to the developing unit body 1 by way of the feeder. Although the toner hopper 4 in this embodiment is formed separately from the developing unit body 1, it is also possible to form the toner hopper 4 integrally with the developing unit body 1 by means of injection molding or other methods. In order to prevent scattering of toner from the toner hopper 4, the toner supply opening 29 formed at the upper end of the toner hopper 4 is closed with the toner cartridge 41 (described later) during toner feeding and with the lid 30 during other times than toner feeding.

When the charging properties of developer supplied from the developer cartridge 2 to the developing unit body 1 are varied, printing quality cannot be uniformly maintained unless toner density or the bias voltage of the magnet roller 9 is changed. Therefore, in this embodiment, the probes 20*a*, 20*b* of the property display means 20 are provided in the cartridge body 3 of the developer cartridge 2 as mentioned above, and the charging properties of developer are indicated by these probes 20*a*, 20*b*. The charging properties are specified for every production lot of developer so that it is enough to set the probes 20*a*, 20*b* in the same condition throughout one production lot.

Figure 6:
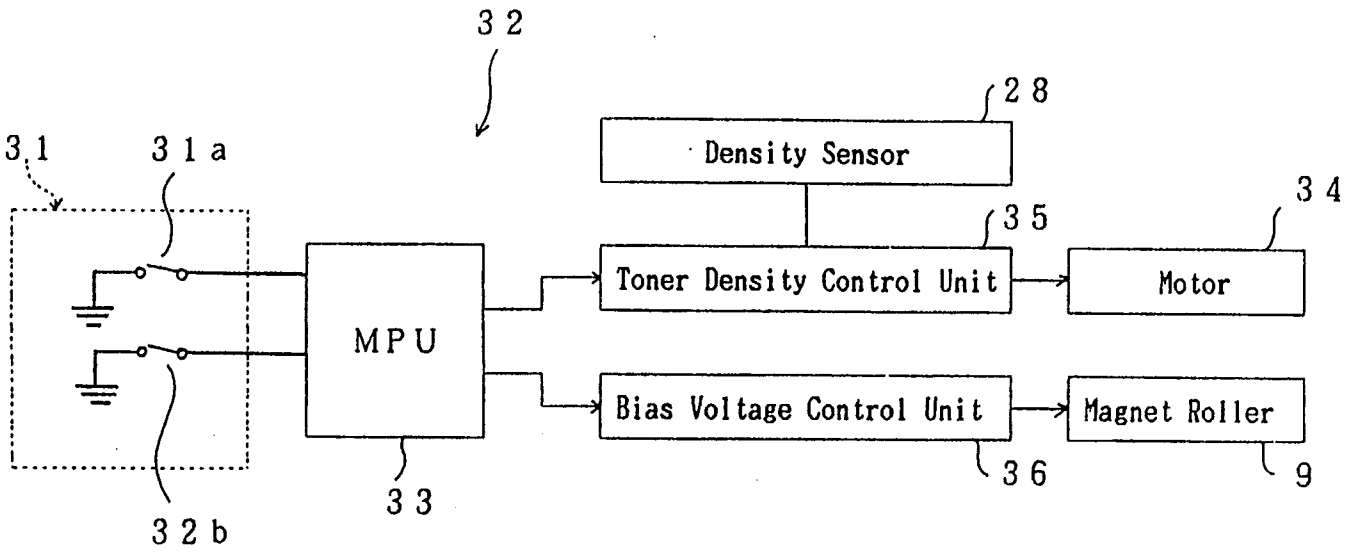

In order to read information indicated by the property display means 20, the developing unit body 1 is provided with a reading means 31 (see FIG. 3). The reading means 31 is comprised of sensors 31*a*, 31*b*. These sensors 31*a*, 31*b* are two switches which are turned on or off in accordance with the presence/absence of the tip portions of the probes 20*a*, 20*b* of the property display means 20 when the cartridge body 3 is mounted on the developing unit body 1. The information on the charging properties read by the reading means 31 is transferred to a control circuit 32 as shown in FIG. 6. The control circuit 32 comprises (i) a main processing unit (MPU) 33 for selecting an optimum toner density control reference value and optimum bias voltage value from table data in accordance with the charging properties read by the reading means 31, (ii) a toner density control unit 35 for controlling the rotation and suspension of a motor 34 for driving the sponge roller 26, based on the optimum toner density control reference value selected by the main processing unit 33 and the output of the density sensor 28, (iii) a bias voltage control unit 36 for applying a bias voltage to the magnet roller 9 based on the optimum bias voltage value selected by the main processing unit 33. Thus, toner density and the bias voltage of the magnet roller 9 are controlled in accordance with the charging properties of developer stored in the cartridge body 3, thereby keeping the printing quality constant.

As shown in FIG. 2, disposed at the bottom of the developing unit body 1 are a discharge opening 37 for discharging degraded developer and a discharge opening lid 38 of e.g. the sliding type for opening/closing the discharge opening 37. The discharge opening lid 38 is operated to open or close by means of a lever 39 disposed at one end of the developing unit body 1.

Figure 7:
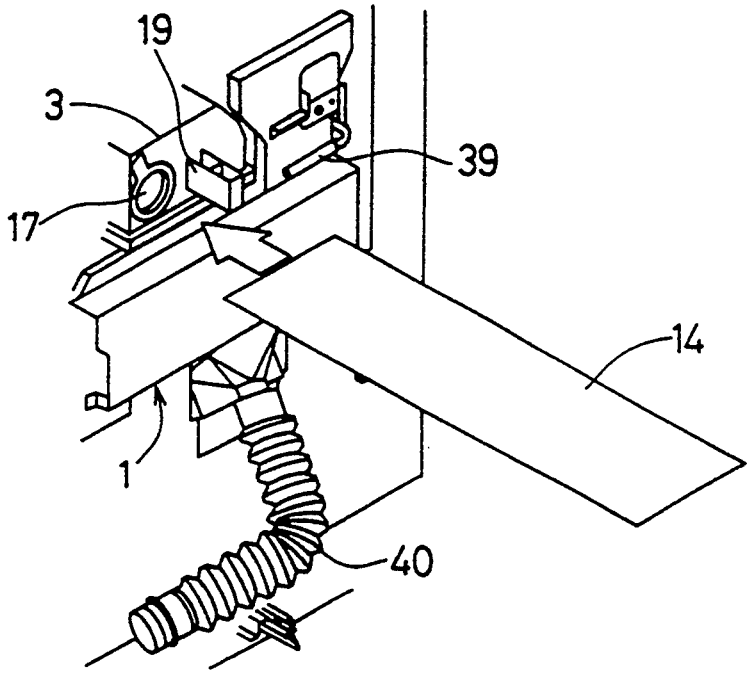
Figure 8:
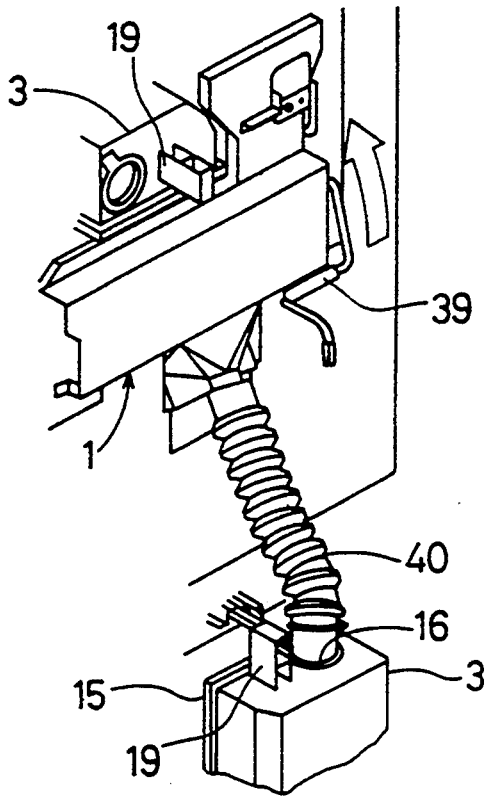

The replacement of degraded developer within the developing unit body 1 is carried out with the following procedure. Firstly, the cardboard sheet 14 is inserted under the empty cartridge body 3 mounted on the developing unit body 1 as shown in FIG. 7 so as to close the developer release opening 12. After the cartridge body 3 has been pulled out together with the cardboard sheet 14, the lid 15 is fitted in the empty developer cartridge 2 and this cartridge 2 is set aside as a recovery container. Thereafter, the cartridge body 3 of the developer cartridge 2 containing fresh developer is mounted on the developing unit body 1 together with the seal 13 attached thereto, so as to close the developer supply opening 22 of the developing unit body 1. A duct for recovery 40 is then tightly connected to the discharge opening 37, while the leading end of the duct 40 is tightly connected to the recovery container, i.e., the developer recovery opening 16 of the above-mentioned empty developer cartridge 2. After the discharge opening 37 has been opened by operating the lever 39, the stirring paddles 5 to 8 are rotated. The above-described operation allows the degraded developer within the developing unit body 1 to be withdrawn in the recovery container through the duct 40 without scattering the developer around. Thereafter, the discharge opening 37 is closed and the seal 13 for the developer cartridge 2 containing new developer therein is removed, thereby supplying the developing unit body 1 with new developer at a moment.

Now there will be explained the toner cartridge for feeding toner to the toner hopper 4, mounted on the upper face of the toner hopper 4.

Figure 9:
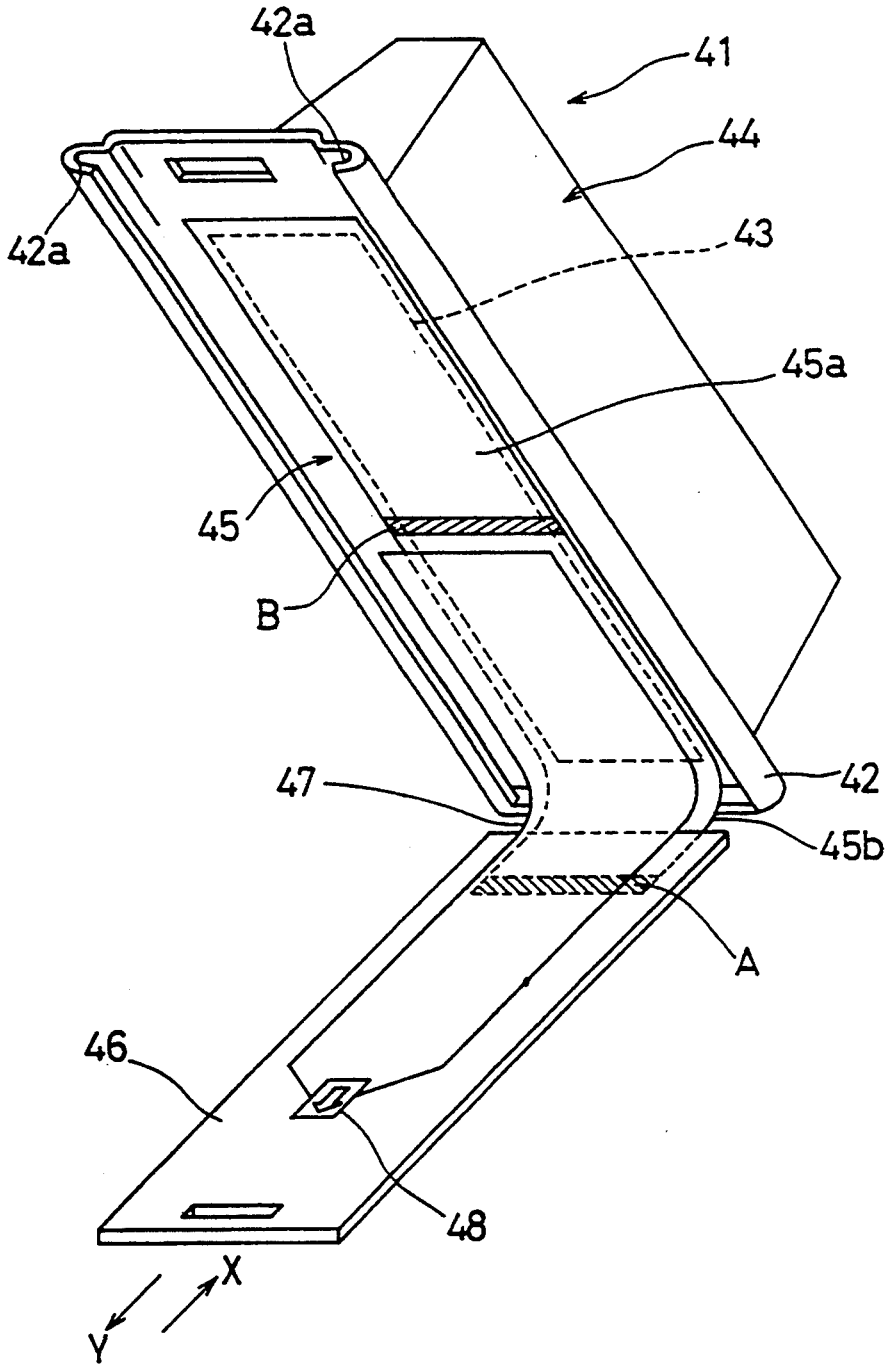

As shown in the exploded perspective view of FIG. 9, the toner cartridge 41 according to this embodiment comprises a rib-like member 42 projecting from the lower end; a toner cartridge body 44 having a toner release opening 43 at the lower face; a seal 45 formed of a synthetic resin film, for sealing the toner release opening 43 of the toner cartridge body 44 in an openable manner; and a lid 46 covering the seal 45 such that it can be inserted into or taken out of the toner cartridge body 44.

The lid 46 has the function of protecting the seal 45 during the storage of the toner cartridge 41 as well as the auxiliary function of stripping off of the seal 45 at the time of toner feeding as described later. The lid 46 is inserted in a guide groove 42*a* formed on the lower side of the rib-like member 42 in the X-Y direction such that it can be freely inserted or taken out, and is brought into engagement with and stopped by a stopper (not shown) disposed under the rear end of the rib-like member 42.

The seal 45 is composed of an adhesive part 45*a* which is affixed to the toner cartridge body 44, covering the toner release opening 43 and a tab part 45*b* which extends from the adhesive part 45*a* and of which leading edge is folded outwardly and securely attached at an attaching part A indicated by hatch on the bottom face of the lid 46 on its inserting side in FIG. 9.

Disposed between the seal 45 and the lid 46 is a tab sheet 47 which is folded into two in the neighbourhood of the inserting end of the lid 46. The leading end of the tab sheet 47 i s fixedly attached at an attaching part B positioned substantially in the middle of the adhesive part 45*a* of the seal 45 in the lengthwise direction and indicated by hatch in FIG. 9. With the middle part of the tab sheet 47 being loosely laid, the other end of the tab sheet 47 (the end on the front side in the inserting direction of the lid 46) is affixed to the upper face of the lid 46 with the help of a temporal tacking member 48. Preferably, as the temporal tacking member 48, a label which can be freely stripped off and indicates the pulling direction is used.

Figure 10A:
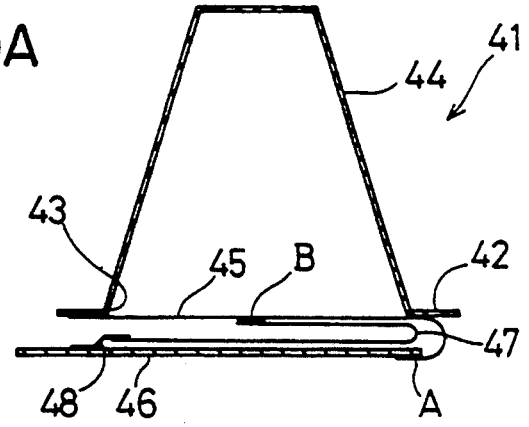
Figure 10B:
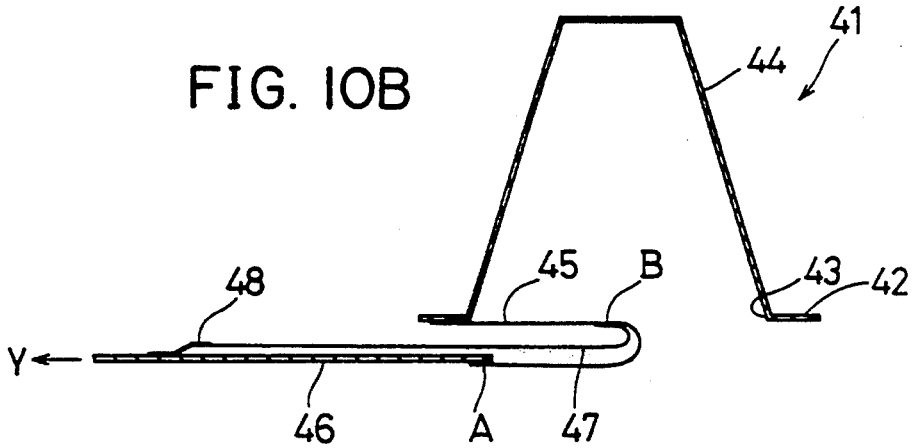
Figure 10C:
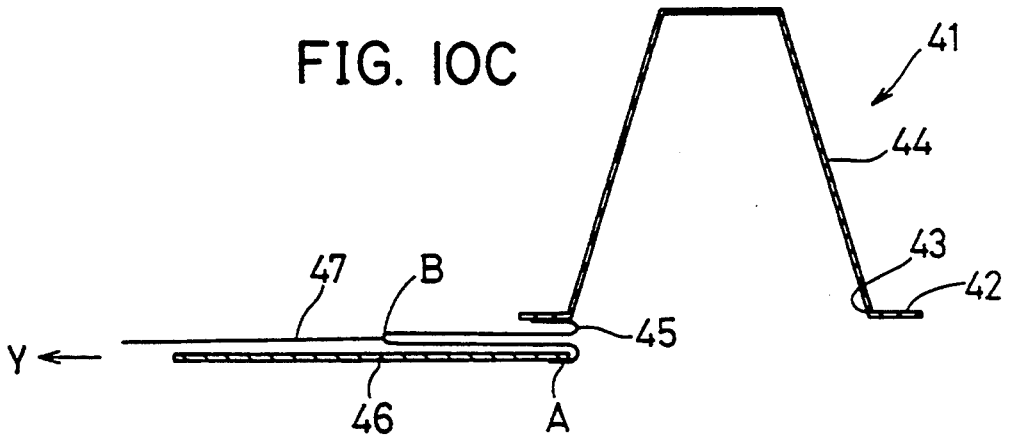

Now reference is made to FIG. 10 for explaining toner supplement operation by the use of the toner cartridge 41 having the above arrangement. In FIG. 10, (*a*) shows the supplement setting state, (*b*) shows the first supplement completion state and (*c*) shows the supplement completion state.

In the supplement setting state as shown in FIG. 10(*a*), wherein the toner cartridge 41 is mounted on the upper face of the toner hopper 4 (not shown in FIG. 10), the toner release opening 43 of the toner cartridge body 44 is sealed by the adhesive part 45*a* (see FIG. 9) of the seal 45 and the seal 45 is covered and protected by the lid 46 disposed at the underside thereof. In this condition, if the lid 46 is pulled out in the Y direction as shown in FIG. 10(*b*), the seal 45 securely attached to the bottom face of the lid 46 on the inserting side thereof will be drawn so that the adhesive part 45*a* will be gradually stripped off from the rear side and the toner release opening 43 will be opened as far as nearly the central part. From the toner release opening 43 thus opened, toner in the toner cartridge body 44 drops downward. In the condition where the lid 46 is accordingly pulled out as far as nearly its end, if the temporary tacking member 48 is stripped off and the end of the tab sheet 47 is pulled in the Y direction as shown in FIG. 10(*c*), the middle part of the seal 45, at which the leading end of the tab sheet 47 is securely attached, will be drawn out. The seal 45 is sequentially folded into two with its toner sticking face directed inward and enfolded, while being pulled forward. At the same time, the remaining portion of the seal 45 which still seals the toner release opening 43 is stripped off so that all of the remaining toner within the toner cartridge body 44 is allowed to drop off and the supplement of toner is thus completed. Accordingly, toner sticking to the inner face of the seal 45 being pulled out is prevented from escaping outside the toner cartridge body 44.

Figure 11:
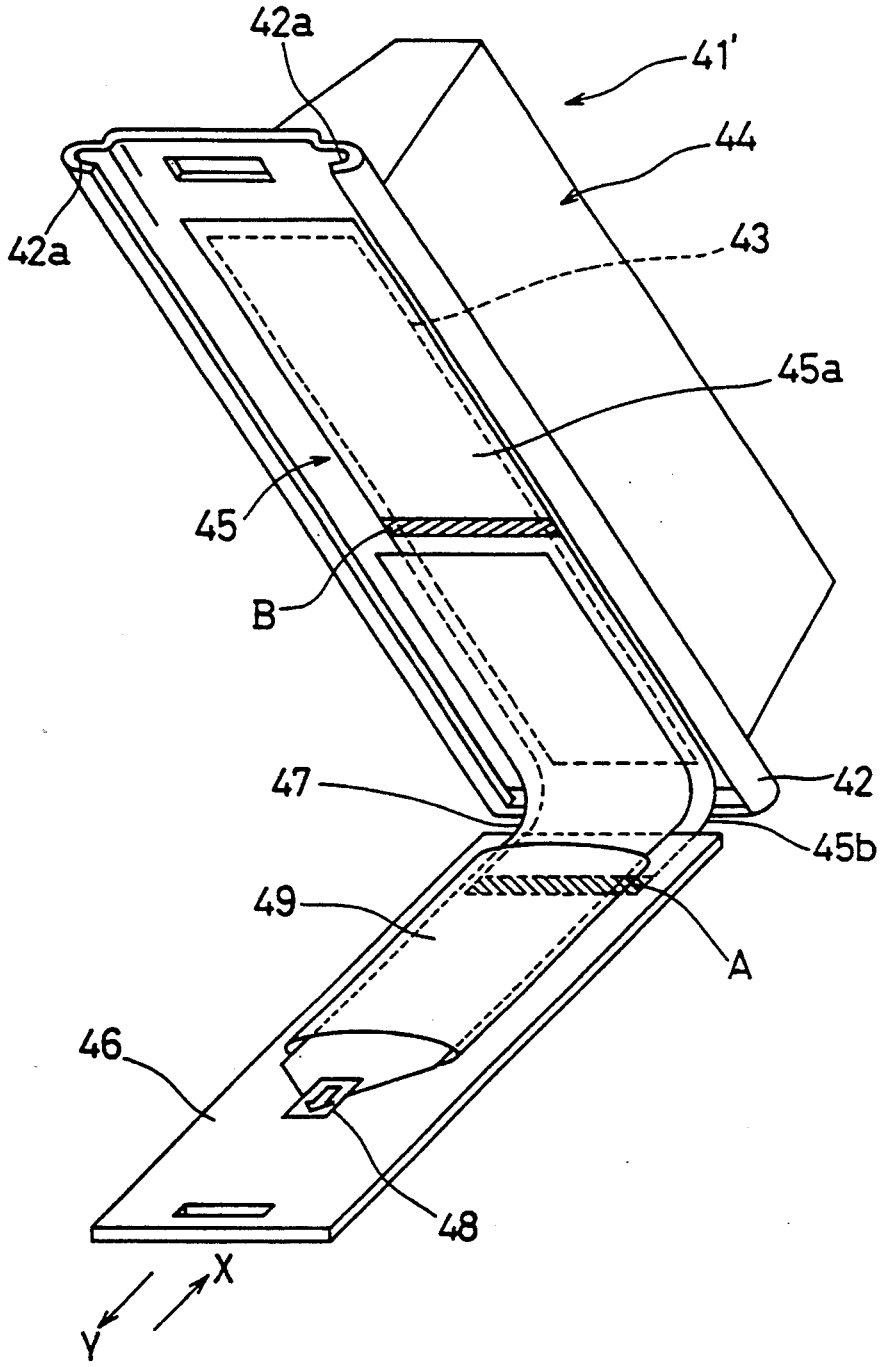

FIG. 11 shows a modification of the toner cartridge of this embodiment. In the toner cartridge 41' shown in FIG. 11, a flat cylindrical sheet 49 through which the tab sheet 47 passes is attached to the inner face of the lid 46 with the help of adhesive etc. Except for the above arrangement, the toner cartridge 41' is identical with the toner cartridge 41 shown in FIG. 9. Therefore, like members in FIG. 11 are indicated by the same reference numerals as in FIG. 9 and a detailed explanation is omitted. The cylindrical sheet 49 is equal to the seal 45 in width and has a length that is more than a half of the length of the adhesive part 45*a* of the seal 45. The cylindrical sheet 49 allows the tab sheet 47 to pass therethrough and the front end of the tab sheet 47 is affixed to the upper face of the lid 46 by means of the temporary tacking member 48.

Figure 12:
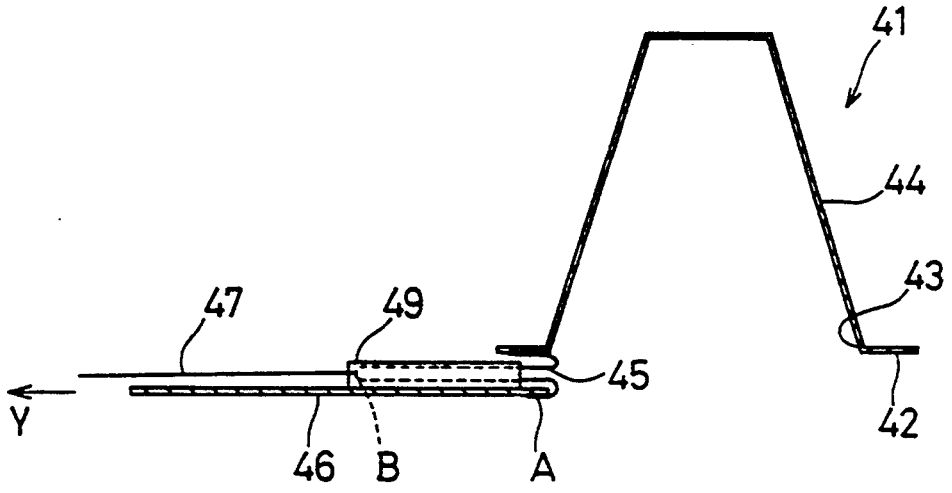

The provision of the cylindrical sheet 49 enables the twice-folded seal 45 to be accommodated within the cylindrical sheet 49 as shown in FIG. 12, so that toner sticking to the seal 45 can be securely prevented from scattering around.

In the developer cartridge of the foregoing embodiment, in order to more securely prevent the scattering of minute particles such as toner at the time of stripping off of the seal, the developer cartridge can be modified to have the following arrangement.

Figure 13:
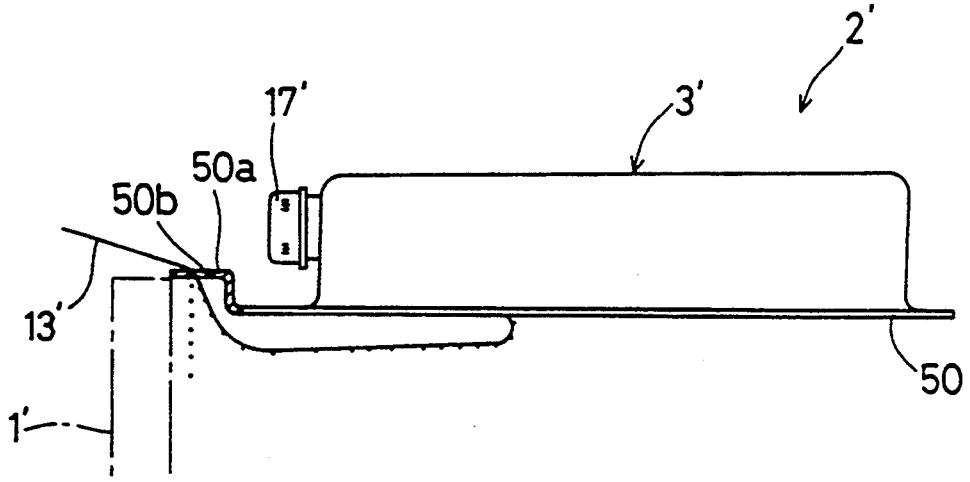

In the modified developer cartridge 2', there is a flange 50 at the opening (developer release opening) of the cartridge body 3' and one end of the flange 50 projects in the lengthwise direction of the cartridge body 3' on the side of a cap 17', as shown in FIG. 13. Formed at the projecting portion is a step 50*a* having a hole 50*b* through which a seal 13' passes. In this arrangement, when the seal 13' is removed from the cartridge body 3', the seal 13' is pulled away with the inner face of the seal 13' being in contact with the edge of the hole 50*b*, whereby developer sticking to the inner face of the seal 13' is scraped off by the edge of the hole 50*b* with the result that it drops into the developing unit body 1' to be recovered therein.

Figure 14:
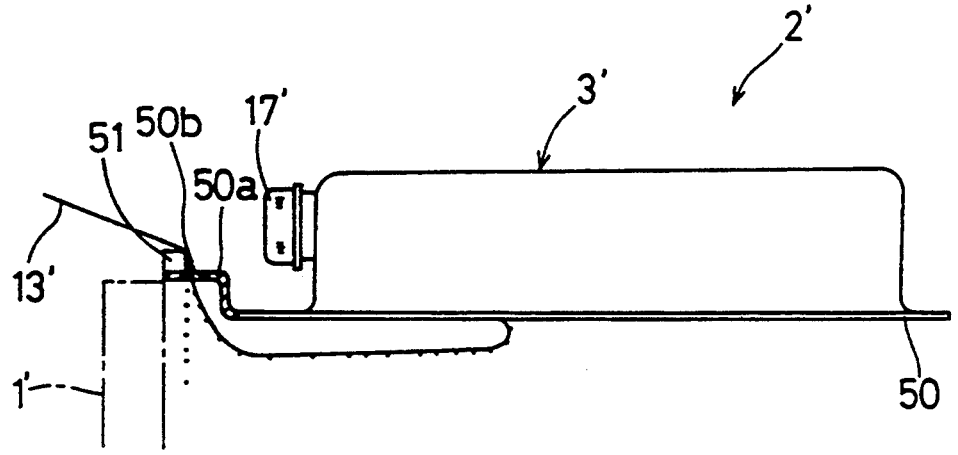

FIG. 14 shows another modification of the developer cartridge. In this example, there is provided a sponge 51 on the upper face of the step 50*a* on the side closer to its leading end than the hole 50*b*. By means of the sponge 51, developer sticking to the inner face of the seal 13' can be also scraped off. The use of the sponge 51 made it possible to surely scrape sticking developer off even if the seal 13' has creases at the surface when the seal 13' is pulled out.

Figure 15A:
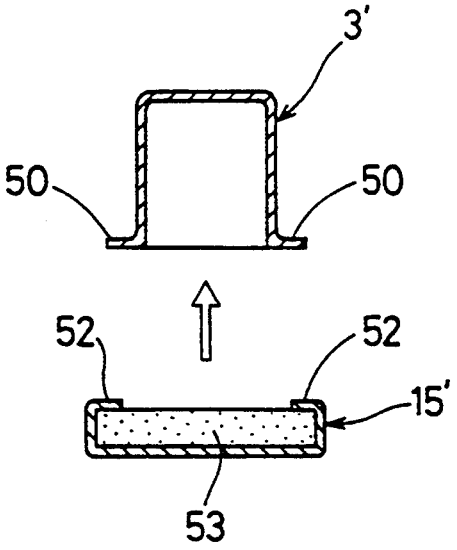
FIGS. 15(*a*) and 15(*b*) are sectional views each showing a structure of a lid for the developer cartridge according to the modification of the embodiment of the invention.
Figure 15B:
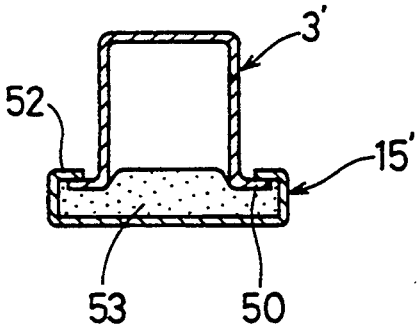

The above embodiment has been particularly described with a developer cartridge in which the opening of the cartridge body is closed with a fitting-type lid, when the developer cartridge is used as a recovery container, but it is also possible to use a lid 15' shown in FIG. 15(*a*) as a covering means for the opening, the lid 15' having an inwardly bent part 52 for engaging with the flange 50 disposed around the opening of the cartridge body 3' and a sponge 53 embedded therein. With such a lid 15', the flange 50 of the cartridge body 3' is inserted between the bent part 52 and the sponge 53 with the sponge 53 deformed as shown in FIG. 15(*b*), whereby the opening of the cartridge body 3' can be securely closed by the lid 15'.

Although the property display means of the foregoing embodiment is provided with two probes (projections) to indicate three stages of properties, the number of probes could be three or more. In such a case, when the probes are also used as a means for detecting the loading of the developer cartridge like the embodiment, the probes can indicate $2^n-1$ kinds of lot numbers where n represents the number of probes. On the other hand, in a case where a means for detecting the loading of the developer cartridge is independently provided, the probes may indicate $2^n$ kinds of lot numbers where n is the number of probes.

Instead of these projections, the property display means is made up of characters, codes, bar codes or the like provided on the surface of the cartridge body. Such characters etc. may be directly printed or inscribed on the cartridge body, or alternatively, a label consisting of a metallic foil, synthetic resin film or paper on which such characters are printed or inscribed may be attached to the cartridge body. In such cases, it is necessary to arrange the reading means so as to suit for the corresponding property display means.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A developing unit comprising:

a developing unit body having a developer supply opening for supplying developer; and a developer cartridge, which is removably mounted on the developing unit body to cover and tightly seal the developer supply opening, which has a developer release opening interconnected with the developer supply opening and which has the function of a lid for closing the developer supply opening that remains continuously closed after developer has been released into the developing unit body through the developer release opening, wherein the developer cartridge has a sealing member for sealing the developer release opening to be openable, the sealing member being removed from the developer release opening when developer is released from the developer release opening, wherein the sealing member is composed of an adhesive part attached to the developer cartridge to cover the developer release opening and a non-adhesive part which is folded toward the outer face of the adhesive part so as to be disposed on the adhesive part in an overlapping manner, and wherein the developer cartridge comprises a cardboard sheet disposed such that it is inserted along the developer release opening to cover the sealing member and can be taken out from the inserted position and a physical lid placed on the cardboard sheet, the cardboard sheet and physical lid being removed when the developer cartridge is mounted on the developing unit body.

2. A developing unit comprising:

a developing unit body having a developer supply opening for supplying developer; and a developer cartridge, which is removably mounted on the developing unit body to cover and tightly seal the developer supply opening, which has a developer release opening interconnected with the developer supply opening and which has the function of a lid for closing the developer supply opening that remains continuously closed after developer has been released into the developing unit body through the developer release opening, wherein the developer cartridge has a sealing member for sealing the developer release opening to be openable, the sealing member being removed from the developer release opening when developer is released from the developer release opening, wherein the sealing member is composed of an adhesive part attached to the developer cartridge to cover the developer release opening and a non-adhesive part which is folded toward the outer face of the adhesive part so as to be disposed on the adhesive part in an overlapping manner, and wherein the developer cartridge is provided with a scraper means for scraping developer sticking to the surface of the sealing member in order to drop the developer into the developing unit body when the sealing member is removed from the developer release opening.

3. The developing unit as claimed in claim 2, wherein the scraper means has a hole defined by an edge, which pierces through the developer cartridge and which scrapes developer while the sealing member moves being inserted therein.

4. The developing unit as claimed in claim 2, wherein the scraper means is a sponge provided in the developer cartridge, for scraping developer while the sealing member moves being in contact therewith.

5. A developing unit a developing unit body having a developer supply opening for supplying developer; and a developer cartridge, which is removably mounted on the developing unit body to cover and tightly seal the developer supply opening, which has a developer release opening interconnected with the developer supply opening and which has the function of a lid for closing the developer supply opening that remains continuously closed after developer has been released into the developing unit body through the developer release opening, wherein the developer cartridge has a developer recovery opening for recovering developer from the developing unit body and a cap for covering the developer recovery opening.

6. A developing unit a developing unit body having a developer supply opening for supplying developer; and a developer cartridge, which is removably mounted on the developing unit body to cover and tightly seal the developer supply opening, which has a developer release opening interconnected with the developer supply opening and which has the function of a lid for closing the developer supply opening that remains continuously closed after developer has been released into the developing unit body through the developer release opening, wherein the developer cartridge is provided with property display means for indicating properties of developer stored in the developer cartridge while the developing unit body is provided with reading means for reading information indicated by the property display means to transfer to a control circuit for controlling the operation of the developing unit.

7. The developing unit as claimed in claim 6, wherein the reading means has a plurality of sensors and the property display means has at least one probe corresponding to the sensors.

8. The developing unit as claimed in claim 6, wherein the control circuit comprises a toner density control unit for controlling the amount of toner to be supplied to the developing unit body and a bias voltage control unit for controlling the value of a bias voltage to be applied to a magnet roller.

9. A toner cartridge removably mounted on a toner hopper of a developing unit, comprising:

(a) a toner cartridge body for storing toner therein, provided with a toner release opening that is interconnected with a toner supply opening of the toner hopper;

(b) a lid that can be inserted into and taken out of the toner cartridge body;

(c) a sealing member sealing the toner release opening of the toner cartridge body, the leading edge of the sealing member being fixed to an end of the lid on the side from which the lid is inserted; and (d) a tab sheet a first end of which is secured to the middle position of the sealing member and a second end of which is loosely temporarily affixed to the lid such that it can be freely stripped off, wherein the sealing member can be folded in two in such a manner that the face having toner sticking thereto is directed inwardly, by pulling the tab sheet after the lid has been pulled out as far as a specified position.

10. The toner cartridge as claimed in claim 9, wherein the lid is provided with a fiat, cylindrical sheet in the inserting/pulling-out direction thereof on a side facing to the toner release opening and the second end of the tab sheet passes through the cylindrical sheet to be temporarily affixed to the lid.

11. The toner cartridge as claimed in claim 10, wherein the cylindrical sheet has a length with which the twice-folded toner sticking face of the sealing member can be accommodated in the cylindrical sheet.

* * * * *